US010844676B2

(12) United States Patent
Zonoz

(10) Patent No.: US 10,844,676 B2
(45) Date of Patent: Nov. 24, 2020

(54) PIPE RAM ANNULAR ADJUSTABLE RESTRICTION FOR MANAGED PRESSURE DRILLING WITH CHANGEABLE RAMS

(71) Applicant: Schlumberger Technology Corporation, Sugar Land, TX (US)

(72) Inventor: Ray Zonoz, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/469,642

(22) PCT Filed: Dec. 13, 2017

(86) PCT No.: PCT/US2017/065966
§ 371 (c)(1),
(2) Date: Jun. 14, 2019

(87) PCT Pub. No.: WO2018/118550
PCT Pub. Date: Jun. 28, 2018

(65) Prior Publication Data

US 2020/0087998 A1 Mar. 19, 2020

Related U.S. Application Data

(60) Provisional application No. 62/437,831, filed on Dec. 22, 2016.

(51) Int. Cl.
*E21B 21/08* (2006.01)
*E21B 33/06* (2006.01)
(Continued)

(52) U.S. Cl.
CPC ..... *E21B 21/08* (2013.01); *E21B 44/00* (2013.01); *E21B 21/001* (2013.01);
(Continued)

(58) Field of Classification Search
CPC ..... E21B 21/08; E21B 33/062; E21B 33/061; E21B 19/146
See application file for complete search history.

(56) References Cited

U.S. PATENT DOCUMENTS 6,554,247 B2 4/2003 Berckenhoff et al.
6,904,891 B2 6/2005 Tominaga et al.
(Continued)

FOREIGN PATENT DOCUMENTS

GB 2478119 A 8/2011
RU 2019681 C1 9/1994
(Continued)

OTHER PUBLICATIONS

International Preliminary Report on Patentability for the equivalent International patent application PCT/US2017/065966 dated Jul. 4, 2019.
(Continued)

*Primary Examiner* — Cathleen R Hutchins
(74) *Attorney, Agent, or Firm* — Jeffrey D. Frantz

(57) ABSTRACT

An apparatus includes a housing and at least two pipe ram systems engageable with the housing. Each of the at least two pipe ram systems comprises an actuator, a bonnet and a sealing pipe ram element. The at least two pipe ram systems are disposed on opposed sides of the housing. A carousel is disposed proximate at least one of the at least two pipe ram systems. The carousel has mounted thereon a plurality of pipe ram systems. The carousel is rotatable to orient a selected one of the plurality of pipe ram systems toward a receiving bore in the housing.

18 Claims, 4 Drawing Sheets

(51) Int. Cl.

| | |
|---|---|
| ***E21B 44/00*** | (2006.01) |
| *E21B 21/00* | (2006.01) |
| *E21B 34/00* | (2006.01) |
| *E21B 47/06* | (2012.01) |

(52) U.S. Cl.
CPC ..... *E21B 21/085* (2020.05); *E21B 33/062* (2013.01); *E21B 34/00* (2013.01); *E21B 47/06* (2013.01)

(56) References Cited

U.S. PATENT DOCUMENTS

| | | | | |
|---|---|---|---|---|
| 6,904,981 | B2 | 6/2005 | van Riet | |
| 7,121,348 | B2 | 10/2006 | Hemphill et al. | |
| 7,395,878 | B2 | 7/2008 | Reitsma et al. | |
| 7,562,723 | B2 | 7/2009 | Reisma | |
| 9,476,271 | B2 | 10/2016 | Judge et al. | |
| 2005/0242309 | A1* | 11/2005 | Brugman | E21B 33/062 251/1.3 |
| 2006/0243451 | A1* | 11/2006 | Hemphill | E21B 33/062 166/379 |
| 2013/0140034 | A1 | 6/2013 | Ghasripoor et al. | |
| 2014/0090888 | A1 | 4/2014 | Smith et al. | |
| 2015/0176347 | A1 | 6/2015 | Bansal et al. | |
| 2015/0240581 | A1* | 8/2015 | Nicholson | E21B 21/08 251/318 |
| 2016/0097248 | A1* | 4/2016 | Mathieson | E21B 33/0355 166/363 |

FOREIGN PATENT DOCUMENTS

| | | | |
|---|---|---|---|
| WO | 2011/084153 | A1 | 7/2011 |
| WO | 2016/054364 | A1 | 4/2016 |

OTHER PUBLICATIONS

"Ram Preventers as Well Control Equipment," retrieved on Jun. 13, 2019 at http://www.drillingformulas.com/ram-preventers-as-well-control-equipment/.

International Search Report and Written Opinion for the equivalent International patent application PCT/US2017/065966 dated Mar. 22, 2018.

Extended Search Report for the counterpart European patent application 17884864.4 dated Jun. 25, 2020.

* cited by examiner

PIPE RAM ANNULAR ADJUSTABLE RESTRICTION FOR MANAGED PRESSURE DRILLING WITH CHANGEABLE RAMS

BACKGROUND

This application claims the benefit of and priority to a US Provisional Application having Ser. No. 62/437,831, filed 22 Dec. 2016, which is incorporated by reference herein.

The disclosure relates generally to the field of "managed pressure" wellbore drilling. More specifically, the disclosure relates to managed pressure control apparatus and methods which do not require the use of a rotating control device ("RCD"), rotating blowout preventer or similar apparatus to restrict or close a wellbore annulus.

Managed pressure drilling uses well pressure control systems that control return flow of drilling fluid in a wellbore annulus to maintain a selected pressure or pressure profile in a wellbore. U.S. Pat. No. 6,904,891 issued to van Riet describes one such system for controlling wellbore pressure during the drilling of a wellbore through subterranean formations. The system described in the '891 patent includes a drill string extending into the wellbore. The drill string may include a bottom hole assembly ("BHA") including a drill bit, drill collars, sensors (which may be disposed in one or more of the drill collars), and a telemetry system capable of receiving and transmitting sensor data between the BHA and a control system disposed at the surface. Sensors disposed in the bottom hole assembly may include pressure and temperature sensors. The control system may comprise a telemetry system for receiving telemetry signals from the sensors and for transmitting commands and data to certain components in the BHA.

A drilling fluid ("mud") pump or pumps may selectively pump drilling fluid from a drilling fluid reservoir, through the drill string, out from the drill bit at the end of the drill string and into an annular space created as the drill string penetrates the subsurface formations. A fluid discharge conduit is in fluid communication with the annular space for discharging the drilling fluid to the reservoir to clean the drilling fluid for reuse. A fluid back pressure system is connected to the fluid discharge conduit. The fluid back pressure system may include a flow meter, a controllable orifice fluid choke, a back pressure pump and a fluid source coupled to the pump intake. The back pressure pump may be selectively activated to increase annular space drilling fluid pressure. Other examples may exclude the back pressure pump.

Systems such as those described in the van Riet '891 patent comprise a RCD or similar rotatable sealing element at a selected position, in some implementations at or near the upper end of the wellbore. The upper end of the wellbore may be a surface casing extending into the subsurface and cemented in place, or in the case of marine wellbore drilling, may comprise a conduit called a "riser" that extends from a wellhead disposed on the water bottom and extending to a drilling platform proximate the water surface. Further, in such systems as described in the van Riet '891 patent, a fluid discharge line from the upper end of the wellbore but below the RCD may comprise devices such as a controllable orifice choke such that drilling fluid returning from the wellbore may have its flow controllably restricted to provide a selected fluid pressure in the wellbore or a selected fluid pressure profile (i.e., fluid pressure with respect to depth in the wellbore).

FIG. 1 shows an example of a well drilling system 100 that uses a rotating control device (RCD) to close fluid discharge from a subsurface wellbore so that it is constrained to flow through a controllable orifice choke. Using the controllable orifice choke and measurements from certain sensors, explained below, a selected fluid pressure or fluid pressure profile may be maintained in the wellbore. While the present example embodiment and an embodiment according to the disclosure described with reference to FIG. 2, are described with reference to drilling a well below the bottom of the land surface, methods and apparatus according to the present disclosure may also be used with apparatus and methods for drilling into formations below the bottom of a body of water.

The well drilling system may make use of a managed pressure drilling (MPD) system during drilling of a wellbore to adjust the fluid pressure in a wellbore annulus to selected values during drilling. Operation and details of the MPD system may be substantially as described in U.S. Pat. No. 7,395,878 issued to Reitsma et al. and in U.S. Pat. No. 6,904,981 issued to van Riet.

The well drilling system 100 includes a hoisting device known as a drilling rig 102 that is used to support drilling a wellbore through subsurface rock formations such as shown at 104. Many of the components used on the drilling rig 102, such as a kelly (or top drive), power tongs, slips, draw works and other equipment are not shown for clarity of the illustration. A wellbore 106 is shown being drilled through the rock formations 104. A drill string 112 is suspended from the drilling rig 102 and extends into the wellbore 106, thereby forming an annular space (annulus) 115 between the wellbore 106 wall and the drill string 112, and/or between a casing 101 and the drill string 112. The drill string 112 is used to convey a drilling fluid 150 (shown in a storage tank or pit 136 to the bottom of the wellbore 106 and into the wellbore annulus 115.

The drill string 112 may support a bottom hole assembly (BHA) 113 proximate the lower end thereof that includes a drill bit 120, and may include a mud motor 118, a sensor package 119, a check valve (not shown) to prevent backflow of drilling fluid from the annulus 115 into the drill string 112. The sensor package 119 may be, for example, a measurement while drilling and logging while drilling (MWD/LWD) sensor system. In particular the BHA 113 may include a pressure transducer 116 to measure the pressure of the drilling fluid in the annulus at the depth of the pressure transducer 116. The BHA 113 shown in FIG. 1 may also include a telemetry transmitter 122 that can be used to transmit pressure measurements made by the transducer 116, MWD/LWD measurements as well as drilling information to be received at the surface. A data memory including a pressure data memory may be provided at a convenient place in the BHA 113 for temporary storage of measured pressure and other data (e.g., MWD/LWD data) before transmission of the data using the telemetry transmitter 122. The telemetry transmitter 122 may be, for example, a controllable valve that modulates flow of the drilling fluid through the drill string 112 to create pressure changes in the drilling fluid 150 that are detectable at the surface. The pressure changes may be coded to represent signals from the MWD/LWD system (sensor package 119) and the pressure transducer 116.

The drilling fluid 150 may be stored in a reservoir 136, which is shown in the form of a mud tank or pit. The reservoir 136 is in fluid communications with the intake of one or more mud pumps 138 that in operation pump the drilling fluid 150 through a conduit 140. A flow meter 152 may be provided in series with one or more mud pumps 138. The conduit 140 is connected to suitable pressure sealed swivels (not shown) coupled to the uppermost segment ("joint") of the drill string 112. During operation, the drilling fluid 150 is lifted from the reservoir 136 by the pumps 138, is pumped through the drill string 112 and the BHA 113 and exits the through nozzles or courses (not shown) in the drill bit 120, where it circulates the cuttings away from the bit 120 and returns them to the surface through the annulus 115. The drilling fluid 150 returns to the surface and passes through a drilling fluid discharge conduit 124 and in some embodiments through various surge tanks and telemetry receiver (e.g., a pressure sensor—not shown) to be returned, ultimately, to the reservoir 136.

A pressure isolating seal for the annulus 115 is provided in the form of a rotating control device (RCD) mounted above a blowout preventer ("BOP") 142. The drill string 112 passes through the BOP 142 and its associated RCD. When actuated, the RCD seals around the drill string 112, isolating the fluid pressure therebelow, but still enables drill string rotation and longitudinal movement. Alternatively a rotating BOP (not shown) may be used for essentially the same purpose. The pressure isolating seal forms a part of a back pressure system used to maintain a selected fluid pressure in the annulus 115.

As the drilling fluid returns to the surface it passes through a side outlet below the RCD to a back pressure system 131 configured to provide an adjustable back pressure on the drilling fluid in the annulus 115. The back pressure system 131 comprises a variable flow restriction device, in some embodiments in the form of a controllable orifice choke 130. It will be appreciated that there exist chokes designed to operate in an environment where the drilling fluid 150 contains substantial drill cuttings and other solids. The controllable orifice choke 130 may one type of a variable flow restriction device and is further capable of operating at variable pressures, flow rates and through multiple duty cycles.

The drilling fluid 150 exits the controllable orifice choke 130 and flows through a flow meter 126, which may then be directed through an optional degasser 1 and solids separation equipment 129. The degasser 1 and solids separation equipment 129 are designed to remove excess gas and other contaminants, including drill cuttings, from the returning drilling fluid 150. After passing through the degasser 1 and solids separation equipment 129, the drilling fluid 150 is returned to reservoir 136. In the present example, the drilling fluid reservoir 136 comprises a trip tank 2 in addition to the mud tank or pit 136. A trip tank may be used on a drilling rig to monitor drilling fluid gains and losses during movement of the drill string into and out of the wellbore 106 (known as "tripping operations").

Various valves 5, 125 and lines 4, 119, 119A, 119B may be provided to operate the back pressure system 131 if and as needed.

The flow meter 126 may be a mass-balance type, Coriolis-type or other high-resolution flow meter. A pressure sensor 147 may be provided in the drilling fluid discharge conduit 124 upstream of the variable flow restrictor (e.g., the controllable orifice choke 130). A second flow meter, similar to flow meter 126, may be placed upstream of the RCD in addition to the pressure sensor 147. The back pressure system 131 may comprise a control system 146 for monitoring measurements from the foregoing sensors (e.g., flow meters 126 and 152 and pressure transducer 147). The control system 146 may provide operating signals to selectively control To enable data relevant for the annulus pressure, and providing control signals to at least a back pressure system 131 and in some embodiments to the mud pumps 138.

The back pressure system 131 may comprise the controllable orifice choke 130, flow meter 126 and a secondary pump 128. Signals from the above described sensors may be conducted to a control unit 146. Control signals from the control unit 146 may be conducted to the mud pump(s) 138, the secondary pump 128 and the controllable orifice choke 130 During operation of the drilling system, if the drilling fluid pump 138 is operating, the back pressure system 131 may provide a selected pressure in the annulus 115 by operating the controllable orifice choke 130 to restrict the flow of drilling fluid 150 leaving the annulus 115. During times when the drilling fluid pump 138 is not operating, the secondary pump 128 may provide drilling fluid under pressure to the annulus 115 to maintain the selected fluid pressure.

In some embodiments, a selected fluid pressure may be applied to the annulus 115 to maintain the desired annulus in the wellbore 106 by obtaining, at selected times, measurements related to the existing pressure of the drilling fluid in the annulus 115 in the vicinity of the BHA 113 using the pressure transducer 116 or similar pressure sensor. Such pressure measurement may be referred to as the bottom hole pressure (BHP). Differences between the determined BHP and the desired BHP may be used for determining a set-point back pressure. The set point back pressure is used for controlling the back pressure system 131 in order to establish a back pressure close to the set-point back pressure. Information concerning the fluid pressure in the annulus 115 proximate the BHA 113 may be determined using an hydraulic model and measurements of drilling fluid pressure as it is pumped into the drill string and the rate at which the drilling fluid is pumped into the drill string (e.g., using a flow meter or a "stroke counter" typically provided with piston type mud pumps). The BHP information thus obtained may be periodically checked and/or calibrated using measurements made by the pressure transducer 116.

In other embodiments, an injection fluid supply 143 which may comprise a storage tank and one or more injection pumps (not shown separately) may use a pressure measurement generated by an injection fluid pressure sensor anywhere in the injection fluid supply passage, e.g., at 156, may be used to provide an input signal for controlling the back pressure system 131, and thereby for monitoring the drilling fluid pressure in the wellbore annulus 115.

The pressure signal may, if so desired, be compensated for the density of the injection fluid column and/or for the dynamic pressure loss that may be generated in the injection fluid between the injection fluid pressure sensor in the injection fluid supply passage and where the injection into the drilling fluid return passage takes place, for instance, in order to obtain an exact value of the injection pressure in the drilling fluid return passage at the depth where the injection fluid is injected into the drilling fluid gap.

The described existing MPD system is effective, however there are limitations inherent to the use of RCDs in controlling fluid leaving a wellbore. It is desirable to provide control of fluid pressure in a wellbore (i.e., annulus) without the need to use RCDs or similar rotating pressure control devices at the upper end of the well.

DETAILED DESCRIPTION

Figure 1:
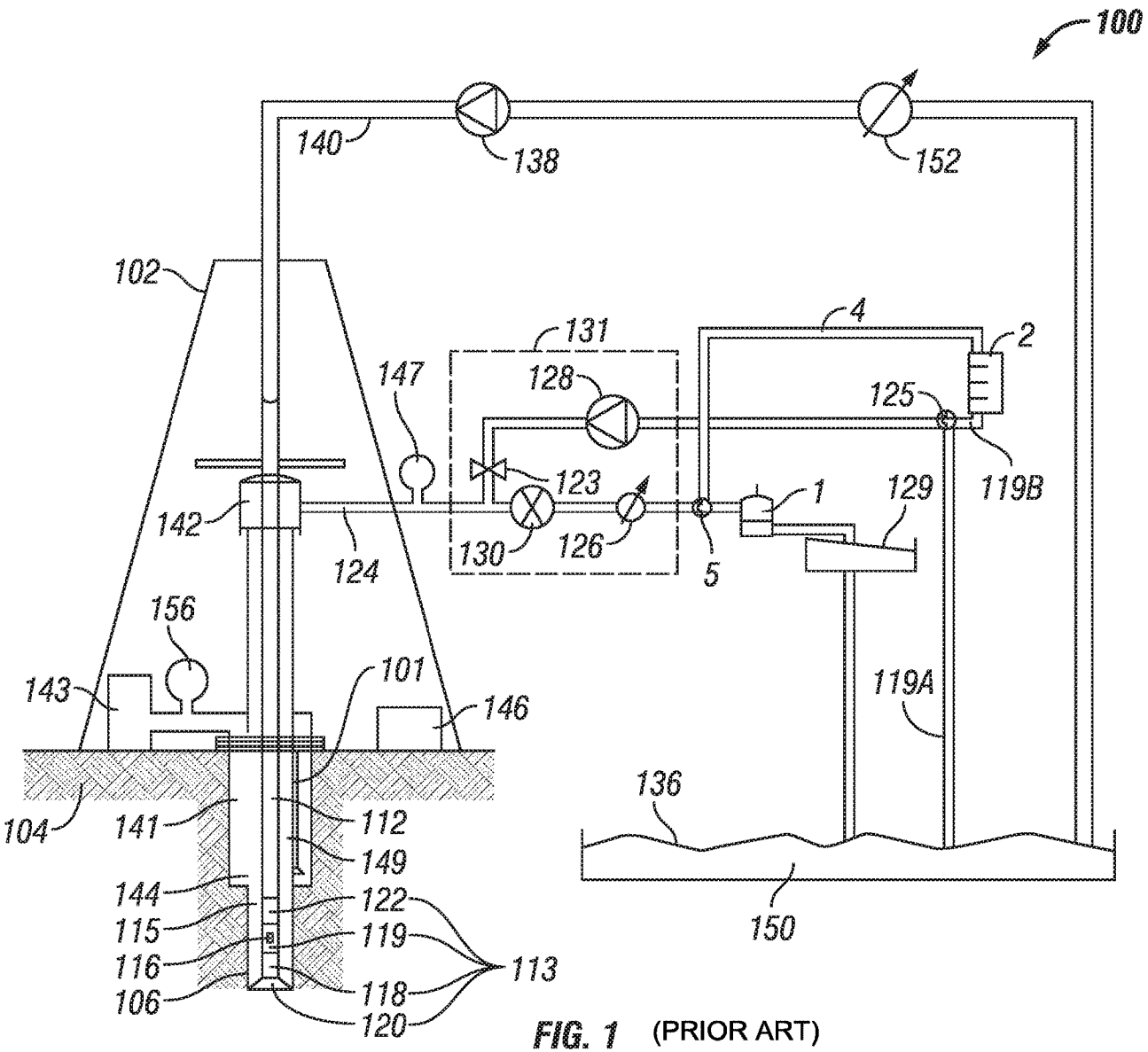
FIG. 1 (PRIOR ART)
FIG. 1 shows an example embodiment of a drilling system including a well pressure control apparatus.
Figure 2:
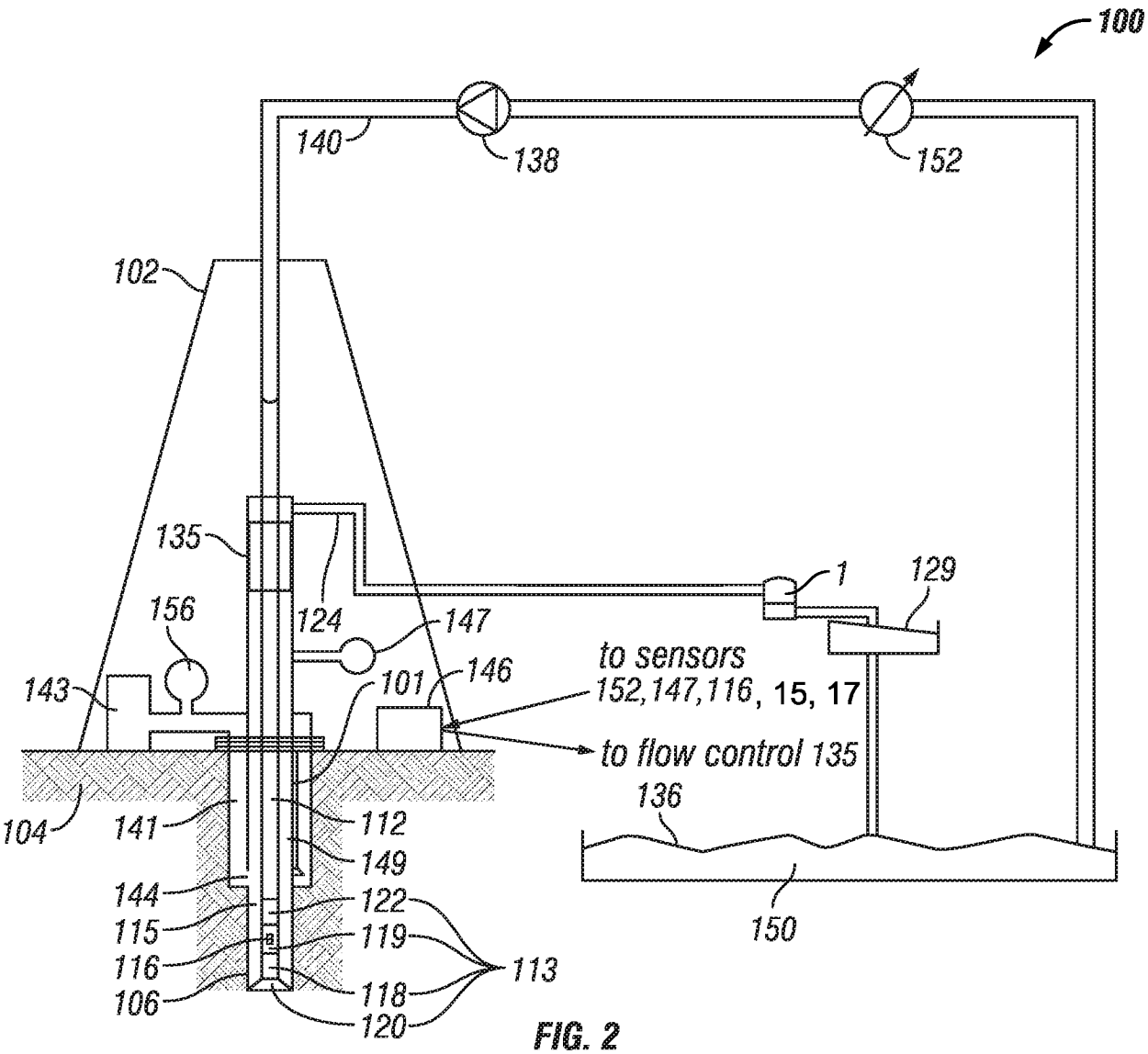
FIG. 2 shows an example embodiment of a drilling system including a well outflow control according to the present disclosure used in connection a well pressure control apparatus.

An example embodiment of a well drilling system 100 that may be used with a well fluid discharge control may be better understood with reference to FIG. 2. The well drilling system 100 may comprise many of the same components described with reference to the well drilling system shown in FIG. 1 and described above.

Components of the example embodiment of the well drilling system in FIG. 2 may omit the backpressure system 131 and the components therein, including, for example the variable orifice choke (130 in FIG. 1), the secondary pump 128, and external to the backpressure system 131, valves 5, 125 lines 4, 119A and 119B. The RCD at the upper end of the BOP 142 may also be omitted. Flow out of the annulus 115 may be controlled by a well fluid outflow control 135 disposed in the well casing 101, above a BOP stack (not shown in FIG. 2). The well casing 101 may comprise a fluid discharge line 124 connected to the wellbore 106 above the well outflow control 135, such that the fluid actually discharged from the wellbore 106 may be at atmospheric pressure, and the wellbore 106 may not need a rotating sealing element such as a RCD (as shown in FIG. 1).

The well fluid outflow control 135 will be further explained below with reference to FIG. 3. In the present example embodiment of a well drilling system, pressure in the annulus 115 may be maintained by communicating to the control system 146 signals from the flow meter 152, pressure transducer 116, pressure sensor 147 and in some embodiments a second flow meter 126 disposed in the fluid discharge line 124. Control signals from the control system 146 may operate the well fluid outflow control 135 and the mud pump(s) 138 to maintain a selected fluid pressure in the annulus 115. The selected fluid pressure may be calculated substantially as explained above with reference to FIG. 1 and in a manner similar to operation of a controllable choke as disclosed in U.S. Pat. No. 6,904,891 issued to van Riet, incorporated herein by reference in its entirety. When the mud pump(s) are switched off, such as during adding a segment of dill pipe to the drill string 112 or removing a segment therefrom, pressure in the annulus 115 may be maintained using the fluid injection system comprising the injection fluid supply 143 which may comprise a storage tank and one or more injection pumps (not shown separately) and the pressure measurement generated by the injection fluid pressure sensor disposed anywhere in the injection fluid supply passage, e.g., at 156.

Figure 3:
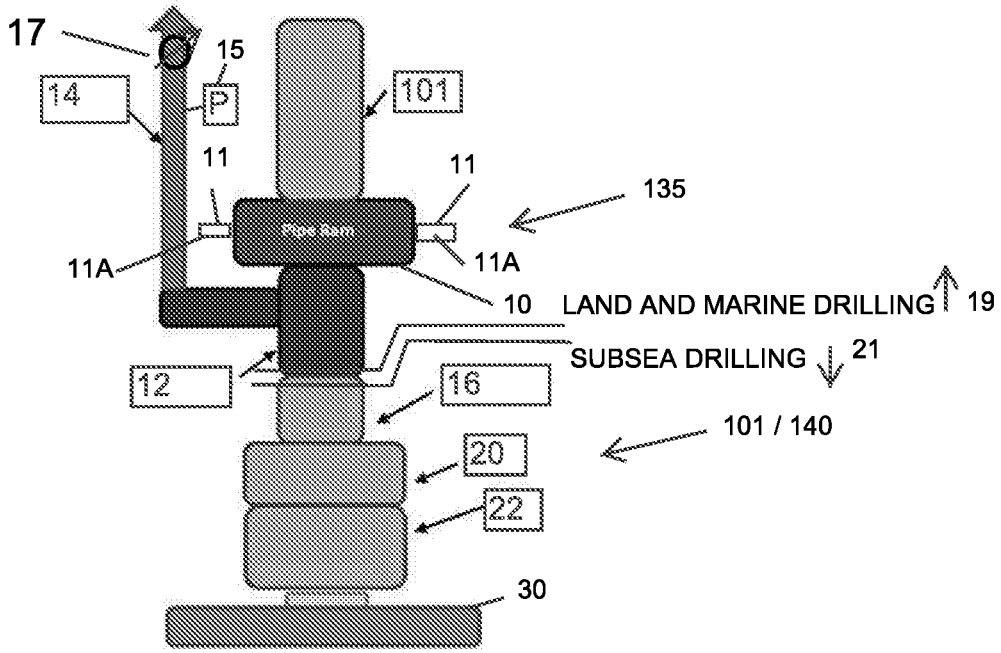
FIG. 3 shows a detailed view of one example embodiment of a well outflow control. The example embodiment is shown in two different installations; one on a land based drilling unit and another on a riser used in marine drilling.

One example embodiment of a well outflow control is shown schematically in FIG. 3. The well fluid outflow control 135 may comprise one or more pipe ram(s) 10 of types known to be used in blowout preventers (BOPs). Pipe rams may comprise one or more sealing elements (not shown separately for clarity) configured to sealingly engage the exterior of tubular members such as drill pipe, drill collars and other drill string components passing through a center bore of the pipe ram 10 when an associated actuator 11 is operated to urge the one or more sealing elements toward the tubular member. In some embodiments, the pipe ram may comprise two, opposed, substantially identical pipe rams that move in opposed directions when actuated. An example pipe ram that may be used in some embodiments is described on the Internet site Drillingformulas.com, in an article entitled, "Ram Preventers as Well Control Equipment", available at the URL http://www.driliingformulas.co/ram-preventers-as-well-control-equipment/downloaded on Dec. 16, 2016. The pipe ram(s) 10 may be operated by the control system 146 to restrict upward flow of drilling fluid out of the wellbore (112 in FIG. 2) so as to maintain a selected setpoint fluid pressure in the wellbore (112 in FIG. 2). A fluid pressure in the wellbore upstream of the well fluid outflow control 135 may be measured by a pressure sensor 15 in fluid communication with a control line 14 coupled to or below the pipe rams 10. Flow rate may be measured in the control line 14 using a flow meter 17, for example a mass flow meter or a Coriolis-type flow meter. Signals from the pressure sensor 15 and the flow meter may be conducted to the control unit (146 in FIG. 2) to enable more precise control of the pipe rams 10 in maintaining a selected pressure in the wellbore (112 in FIG. 2) below the pipe rams 10. After leaving the pipe rams 10, fluid leaving the wellbore may be returned to the well drilling system substantially as explained with reference to FIG. 2.

For land drilling, or for marine drilling with an open riser, the components shown in FIG. 3 above dividing line 19, including flow spool 12 below the pipe rams 10 may be provided. For certain types of marine drilling, wherein pressure control equipment is provided below the bottom of a drilling riser, equipment used to connect the drilling riser to a wellhead 30 on the water bottom may be used. Such equipment may comprise a BOP stack 22, a lower marine riser package 20 and a connector 16 to couple the riser to the lower marine riser package 20. Irrespective of whether the land/marine embodiment or the marine embodiment is used, the pipe ram(s) 10 may provide an automatically (or manually) adjustable flow restriction acting as the well fluid outflow control 135 so that a selected wellbore pressure or wellbore pressure profile is maintained in the well below the well fluid outflow control 135 without the need to use a rotating control device or similar rotating fluid pressure control apparatus. In some embodiments, the actuator(s) 11 may comprise a linear position sensor 11A in signal communication with the control unit (146 in FIG. 2). Measurements of position of the actuator may be used by the control unit 146 to more precisely control the actuator(s) and may be used in some cases to detect a well fluid influx or a loss of well fluid to one or more formations. Techniques for using linear position sensor measurements for such purpose are described in U.S. Pat. No. 7,562,723 issued to Reitsma.

Control of well pressure may be performed automatically by accepting as input to the control system (146 in FIG. 20 measurements made by the various sensors explained with reference to FIGS. 2 and 3, and by the configuring the control system (146 in FIG. 2) to send suitable control signals to the actuators 11 on the pipe rams 10 to maintain the correct restriction on fluid outflow from the wellbore (112 in FIG. 2).

Figure 4:
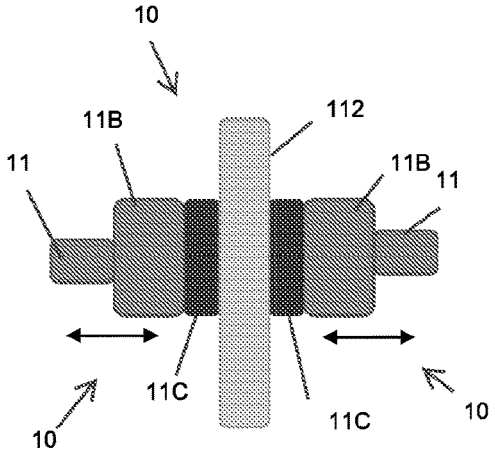
FIGS. 4 and 5 show a side view and a top view, respectively, of a single, opposed actuator pipe ram.

An example embodiment of an opposed-element pipe ram 10 is shown in cut away (with housing omitted to show the active components) side view in FIG. 4 and top view in FIG.

5. The pipe ram 10 may include an actuator 11, which may be for example an hydraulic, pneumatic or electric actuator disposed on opposed sides of the drill string 112. The actuators 11 cooperate with a bonnet 11B to move corresponding ram seal elements 11C to selected distances from the drill string 112 such that the pipe ram 10 may provide suitable well fluid outflow control as described with reference to FIG. 2. For purposes of the present description, a combination of an actuator 11, a bonnet 11B and a ram seal element 11C may be referred to for convenience as a "ram system."

Figure 6:
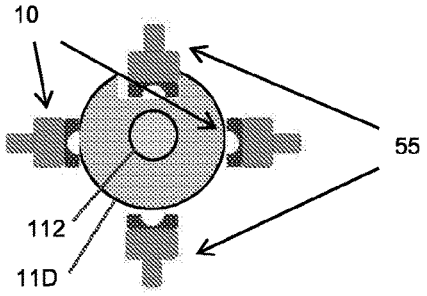
FIGS. 6 and 7 show a top view, respectively, of a double opposed-ram well fluid outflow control and an opposed actuator pipe ram with interchangeable ram and actuator assemblies.
Figure 5:
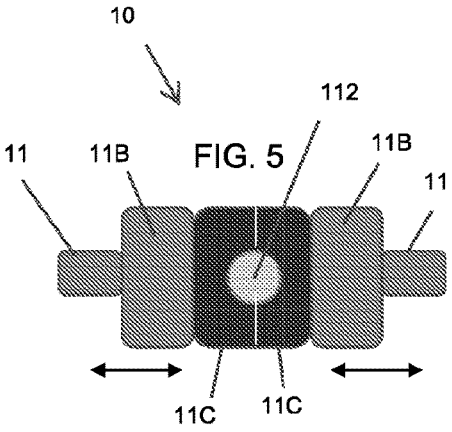

Another possible embodiment of a well fluid outflow control using pipe rams 10 is shown in top view in FIG. 6. Two sets of opposed element pipe rams 10, 55, oriented at right angles to each other may be "stacked" vertically at right angles to each other (so as to minimize the vertical space requirement of the two sets of opposed element pipe rams 10, 55, although such feature is not intended to limit the scope of the present disclosure. In some embodiments, the two sets of opposed pipe rams 10, 55 may be disposed in the same pipe ram housing 11D and such sets of opposed element pipe rams 10, 55 may be individually controllable, e.g., by having a separate control line to the control system (146 in FIG. 2) for each ram actuator (11B in FIGS. 4 and 5), or the opposed element pipe rams 10, 55 may each have an individual actuator (11B in FIGS. 4 and 5) associated therewith operated separately and individually by the control system (146 in FIG. 2).

In some embodiments, a ram system (defined above) for one or more pipe rams 10 may be changeable without the need to remove the housing 11D from its installed position. See FIG. 3 for example installed positions. In an example embodiment shown in FIG. 7, one or more ram systems, e.g., as shown at 11-1 in FIG. 7 may be engaged with the housing 11D. In the present embodiment, two opposed pipe rams 10 may be engaged with the housing 11D. In the present example embodiment, a carousel 50 may be coupled to or disposed proximate the exterior of the housing 11D. In the present example embodiment, one carousel 50 may be disposed opposite a second carousel 50 disposed on an opposed side of the housing 11D. The carousels 50 may each comprise additional ram systems 11-2, 11-3, 11-4, each such additional ram system comprising, for example, an actuator (11 in FIG. 5), a bonnet (11B in FIG. 5) and a ram seal element (11C in FIG. 5). In the present example embodiment, each carousel 50 may be capable of carrying four ram systems, 11-1, 11-2, 11-3 and 11-4. One of the ram systems, e.g., 11-1 may be inserted into and locked into the housing 11D. The insertion of a ram system 11-1 into the housing 11D may be performed, for example by a linear actuator (not shown) when the carousel 50 is rotated such that the selected ram system (e.g., 11-1) is oriented toward the housing 11D. In the event the one of the ram systems (e.g., 11-1) becomes worn or inoperative, such ram system (e.g., 11-1) may be withdrawn to the carousel 50, e.g., using a linear actuator (not shown), and then the carousel 50 may be rotated to align a replacement ram system (e.g., 11-2) with the housing 11D. The replacement ram system (e.g., 11-2) may then be urged into the housing 11D using, for example a linear actuator (not shown). The replacement ram system 11-2 may then be operated in the same manner as the replaced ram system 11-1 to enable the pipe ram 10 to perform its function as a well fluid outflow control. One carousel 50 may be provided on each of two opposed sides of the housing 11D. In some embodiments, both carousels 50 may be operated contemporaneously to replace the ram system 11-1 on both sides of the housing 11D. In some embodiments, the ram systems 11-1, 11-2, 11-3, 11-4 on each side of the housing 11D may be operated independently.

Figure 7:
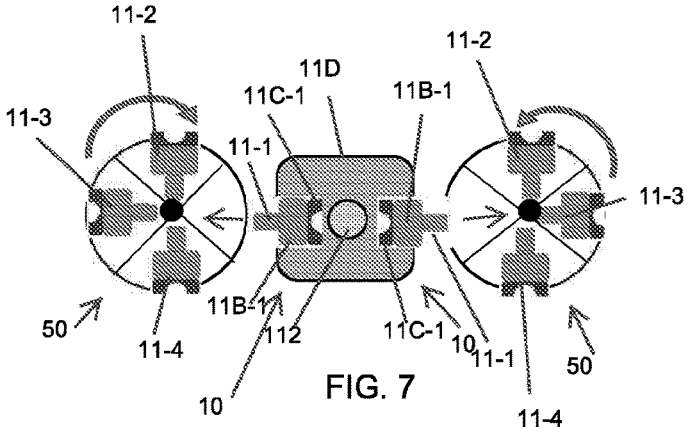

The two carousels 50 shown in FIG. 7 may be operated contemporaneously or may be operated individually based on the condition of the various components of the affected ram system (e.g., 11-1 in FIG. 7). The carousel 50 may be rotated by a motor (not shown), for example, an electric motor, an hydraulic motor or a pneumatic motor.

A non-limiting example of a ram system that may be used in some embodiments is described in U.S. Pat. No. 6,554,247 issued to Berckenhoff et al. and incorporated herein by reference A non-limiting example embodiment of a linear actuator and ram system servicing device that may be used in the carousel 50 are shown in U.S. Pat. No. 7,121,348 issued to Hemphill et al. and incorporated herein by reference.

A well fluid outflow control according to the various aspects of the present disclosure may enable performing managed pressure drilling (MPD) without the need to use a rotating control device or similar rotating sealing element. Such capability may eliminate the time and expense of repair and maintenance of rotating control devices.

While the present disclosure describes a limited number of embodiments, those skilled in the art, having benefit of this disclosure, will appreciate that other embodiments can be devised which do not depart from the scope of what has been disclosed herein. Accordingly, the scope of the disclosure should be limited only by the attached claims.

What is claimed is:

1. A system, comprising:

a drill string extending into a wellbore drilled through subsurface formations;

a pump having an inlet in fluid communication with a supply of drilling fluid, the pump having an outlet in fluid communication with an interior of the drill string;

a conduit extending from a selected axial position in the wellbore to a position proximate a surface end of the wellbore;

at least one well fluid outflow control disposed on an interior surface of the conduit;

wherein the at least one well fluid outflow control comprises a first pipe ram system, a second pipe ram system, and a carousel carrying thereon a plurality of interchangeable pipe ram systems, the first and second pipe ram systems disposed on opposite sides of a well fluid outlet control housing, and the first and second pipe ram systems selectively operable to provide a controlled flow restriction between the first and second pipe ram systems and the drill string; and wherein the carousel is disposed proximate the well fluid outlet flow control housing and is operable to rotate to a position such that one of the plurality of interchangeable pipe ram systems is in alignment with a bore on the well fluid outlet control housing.

2. The system of claim 1 wherein each of the first pipe ram system, the second pipe ram system, and the plurality of interchangeable pipe ram systems comprises a linear actuator.

3. The system of claim 2 wherein each of the first pipe ram system, the second pipe ram system, and the plurality of interchangeable pipe ram systems comprises a linear position sensor arranged to measure a respective amount of linear movement of each of the first pipe ram system, the second pipe ram system, and the plurality of interchangeable pipe ram systems.

4. The system of claim 1 wherein each of the first pipe ram system, the second pipe ram system, and the plurality of interchangeable pipe ram systems comprises a linear position sensor arranged to measure an amount of linear movement of a respective ram seal element forming part of the first pipe ram system, the second pipe ram system, and the plurality of interchangeable pipe ram systems.

5. The system of claim 1 further comprising a pressure sensor arranged to measure pressure of drilling fluid between the drill string and the conduit at a position below the at least one well fluid outflow control.

6. The system of claim 1 further comprising at least one flow meter arranged to measure rate of flow of drilling fluid into the drill string from the pump.

7. The system of claim 1 further comprising a flow meter arranged to measure a rate of flow of drilling fluid out of the conduit.

8. The system of claim 1 further comprising a pressure sensor arranged to measure pressure of drilling fluid at an inlet to the interior of the drill string.

9. The system of claim 1 further comprising a control unit in signal communication with a pressure sensor arranged to measure pressure of drilling fluid at an inlet to the interior of the drill string, the control unit in signal communication with a flow rate sensor arranged to measure a flow rate of fluid into the interior of the drill string, and at least one of a flow rate sensor arranged to measure a rate of fluid outflow from the conduit and a pressure sensor arranged to measure a pressure of fluid in the wellbore upstream of the well fluid outflow control, the control unit operable to maintain a selected fluid pressure in the conduit by selectively operating the plurality of pipe ram systems.

10. A method, comprising:

pumping drilling fluid through a drill string extended into a wellbore drilled through subsurface formations;

returning the pumped drilling fluid through an annular space between an exterior of the drill string and an interior of a conduit disposed to a selected depth in the wellbore;

selectively restricting outflow of fluid from the interior of the conduit by operating at least one well fluid outflow control disposed in the conduit, the at least one well fluid outflow control comprising a first pipe ram system, a second pipe ram system, a housing, and a carousel disposed proximate the housing, the carousel having thereon a plurality of interchangeable pipe ram systems, and the first and second pipe ram systems disposed in the housing and selectively operable to provide a controlled flow restriction between the first and second pipe ram systems and the drill string;

withdrawing the first pipe ram system from the housing to the carousel;

rotating the carousel such that one of the plurality of interchangeable pipe ram systems on the carousel other than the first pipe ram system is in alignment with a receiving bore in the housing; and engaging the one of the plurality of interchangeable pipe ram systems in the receiving bore.

11. The method of claim 10 further comprising measuring a pressure of the drilling fluid in the conduit below the well fluid outflow control, and automatically operating the at least one well fluid outflow control to maintain a selected pressure in the wellbore.

12. The method of claim 10 further comprising measuring a pressure of drilling fluid entering an interior of the drill string and measuring a flow rate of drilling fluid entering the drill string or a flow rate of drilling fluid exiting the conduit, and automatically operating the at least one well fluid outflow control to maintain a selected measured pressure and measured flow rate.

13. The method of claim 10 further comprising measuring a linear extension of pipe ram on each of the first pipe ram system and the second pipe ram system and controlling the linear extension in response to the measured linear extension and a measured pressure of fluid pumped into the drill string.

14. The method of claim 10 wherein:

the housing comprises an additional carousel on an opposite side of the housing from the carousel, the additional carousel comprising a plurality of interchangeable pipe ram systems thereon;

withdrawing the second pipe ram system from the housing to the additional carousel;

rotating the additional carousel such that one of the plurality of interchangeable pipe ram systems of the additional carousel other than the second pipe ram system is aligned with the receiving bore; and engaging the one of the plurality of interchangeable pipe ram systems of the additional carousel with the receiving bore.

15. An apparatus, comprising:

a housing;

a first pipe ram system and a second pipe ram system each engageable with the housing and comprising an actuator, a bonnet and a sealing pipe ram element, the first and second pipe ram systems disposed on opposed sides of the housing; and a carousel disposed proximate at least one of the first and second pipe ram systems, the carousel having mounted thereon a plurality of interchangeable pipe ram systems, the carousel rotatable to orient a selected one of the plurality of interchangeable pipe ram systems toward a receiving bore in the housing.

16. The apparatus of claim 15 wherein each of the plurality of interchangeable pipe ram systems mounted on the carousel comprises an actuator, a bonnet and a sealing pipe ram element.

17. The apparatus of claim 15 wherein at least one of the first and second pipe ram systems comprises a linear position sensor arranged to measure an amount of linear movement of the at least one pipe ram system.

18. The apparatus of claim 15 wherein each of the plurality of interchangeable pipe ram systems comprises a linear position sensor arranged to measure an amount of movement of the respective interchangeable pipe ram system.

* * * * *